US005736261A

United States Patent [19]

Kano

[11] Patent Number: 5,736,261

[45] Date of Patent: Apr. 7, 1998

[54] CONDUCTIVE PASTE

[75] Inventor: Haruhiko Kano, Muko, Japan

[73] Assignee: Murata Manufacturing Co., Ltd., Kyoto-fu, Japan

[21] Appl. No.: 561,544

[22] Filed: Nov. 22, 1995

[30] Foreign Application Priority Data

Nov. 25, 1994 [JP] Japan ..... 6-291435

[51] Int. Cl.[6] ..... B22F 7/04

[52] U.S. Cl. ..... 428/552; 428/553; 75/255; 252/514; 40/501; 174/258

[58] Field of Search ..... 75/255, 252, 254; 501/2; 174/250, 255, 258; 252/514; 420/501; 428/552, 553, 546

[56] References Cited

U.S. PATENT DOCUMENTS 4,331,714 5/1982 Tyran ..... 427/216

4,827,083 5/1989 Inasaka et al. ..... 174/68.5

5,468,695 11/1995 Carroll et al. ..... 501/79

FOREIGN PATENT DOCUMENTS 57-41763 9/1982 Japan .

59-168667 9/1984 Japan .

*Primary Examiner*—Charles T. Jordan

*Assistant Examiner*—Daniel Jenkins

*Attorney, Agent, or Firm*—Ostrolenk, Faber, Gerb & Soffen, LLP

[57] ABSTRACT

A conductive paste in which cracks do not occur even at boundaries between areas of different film thicknesses comprises spherical and flake-form silver powders, a low softening point glass frit, organic rhodium material and an organic vehicle; the proportion of the flake-form silver powder with respect to the total amount of silver powder is in the range 15 to 80 wt % and the proportion of the rhodium contained in the organic rhodium material with respect to the total amount of silver powder is 0.0001 wt % or less.

15 Claims, 1 Drawing Sheet

CONDUCTIVE PASTE

BACKGROUND OF THE INVENTION

1. Field of the Invention

This invention relates to a conductive paste, and particularly to a conductive paste used in forming a defroster.

2. Description of the Related Art

In making a defroster for preventing clouding of a rear window of a car, conventionally a conductive paste made up of a spherical silver powder, a low softening point glass frit and an organic vehicle is used. Such a defroster is formed on a window glass 3 and includes a plurality of horizontal heating strips 1 and a pair of vertical bus bars 2 connecting together the ends of the heating strips 1 at both ends thereof. Such a defroster is generally formed as follows: First, the plurality of horizontal heating strips 1 and the vertical bus bars 2 are simultaneously printed on the surface of a window glass 3 using screens (masks) of the same mesh (mesh coarseness) formed in predetermined graphic patterns. Then, the heating strips 1 and bus bars 2 are baked in a heat treatment carried out during bending and strengthening of the window glass 3.

However, depending on the shape of the pattern of the defroster, it sometimes happens that the bus bars 2 are narrow and produce heat, and when this happens the amount of electricity consumed in the bus bars 2 increases and as a result, the heating strips 1 cease to produce heat.

To avoid the occurrence of this kind of problem, both a high mesh, fine screen and a low mesh, coarse screen have been used; that is, separate screens of different coarsenesses have been prepared, heating strips 1 of small thickness have been formed using a high mesh screen and dried and then bus bars 2 of large thickness and low resistance have been formed using a low mesh screen.

However, when baking is carried out after heating strips 1 and bus bars 2 are formed using a high mesh screen and a low mesh screen, cracks (disconnections) 4 arise at the boundaries of the heating strips 1 and the bus bars 2 and continuity of the heating strips 1 with the bus bars 2 is not secured. This is because the baking shrinkage factor of the bus bars 2 of large thickness is greater than that of the heating strips 1 of small thickness by an amount corresponding to the difference in the film thicknesses, as shown enlarged in FIG. 2.

SUMMARY OF THE INVENTION

It is an object of this invention to provide a conductive paste with which cracks do not occur, even at boundaries between areas of different film thicknesses.

A conductive paste according to the invention comprises spherical silver powder, flake-form (flat) silver powder, a low softening point glass frit, organic rhodium compound and an organic vehicle; the proportion of the flake-form silver powder with respect to the total amount of silver powder is in the range of about 15 to 80 wt % and the proportion of the rhodium contained in the organic rhodium with respect to the total amount of silver powder is about 0.001 wt % or less.

DETAILED DESCRIPTION OF THE PREFERRED EMBODIMENT

A preferred embodiment of the invention will now be described.

A conductive paste according to this preferred embodiment was made by dispersing in an organic vehicle a silver powder comprising a spherical silver powder mixed with a flake-form silver powder, a $B_2O_3$—$SiO_2$—PbO low softening point glass frit and a terpineol solution (hereinafter referred to as organic rhodium solution) of rhodium barium sulfide, which is organic rhodium. Other low softening point, i.e. less than about 500° C., frits can be used, and other organic rhodium materials, i.e. a rhodium-containing material which dissolves in the organic liquid of the paste, can be employed. Likewise, organic liquids other than terpinol can be used.

In general, the silver will constitute about 45 to 85 w %, preferably about 55 to 80 w %, of the paste, the frit will constitute about 1 to 25 w %, preferably about 2 to 18 w %, of the paste, and the organic vehicle will constitute about 10 to 50 w %, preferably about 13 to 40 w %, of the paste.

Figure 1:
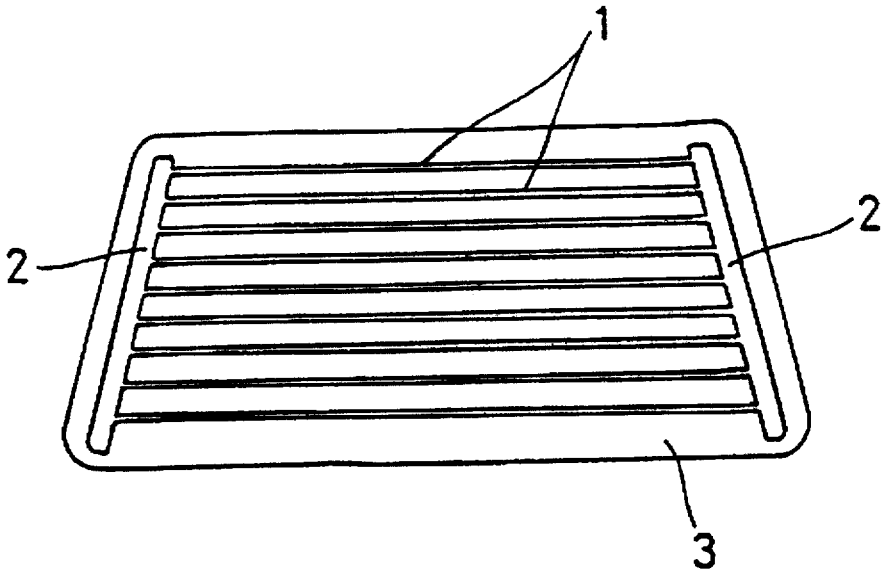
FIG. 1 is a simplified view illustrating the construction of a defroster.
Figure 2:
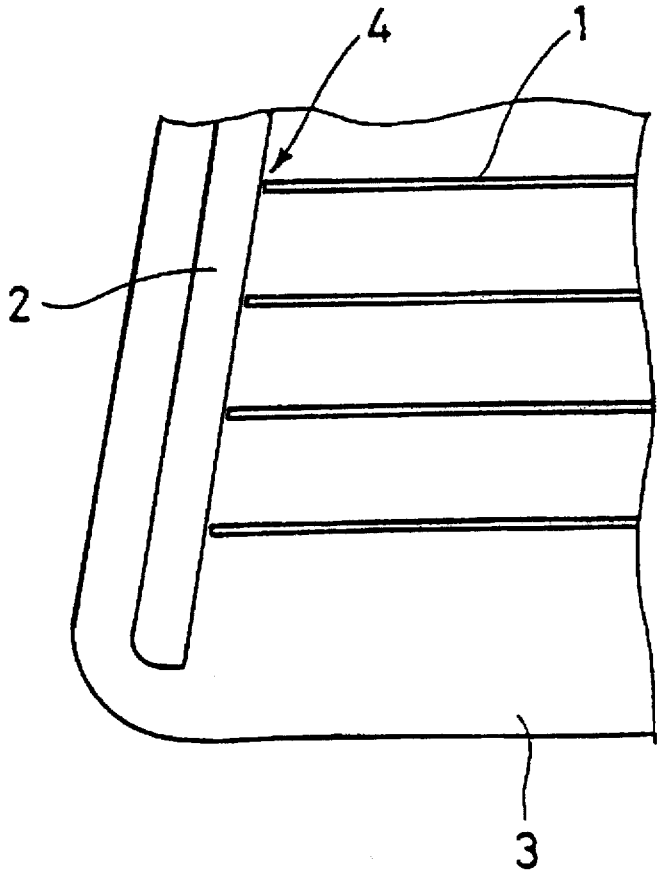
FIG. 2 is an enlarged view of a part of the defroster of FIG. 1.

It is preferable that the proportion of the flake-form silver powder with respect to the total amount of silver powder is in the range of about 15 to 80 wt %. The proportion of the rhodium contained in the organic rhodium material with respect to the total amount of silver powder is preferably about 0.001 wt % or less, and more preferably in the range of about 0.00001 wt % to 0.001 wt %. That is, this conductive paste is one used for example for making a defroster of the shape shown in FIG. 1; the proportion of silver powder is 70 wt %, the proportion of the low softening point glass frit is 3 wt %, the proportion of the organic rhodium solution with respect to the whole of the paste is as shown in Table 1, which will be further discussed later, the remainder is the organic vehicle and the viscosity of the paste is adjusted to 80 to 100 Pa·S (Pascal seconds).

The microtrack $D_{50}$ of the spherical silver powder used here is 1 to 2 μm; the SEM particle diameter (average of long and short dimensions of the flake) of the flake-form silver powder is 3 to 30 μm and the aspect ratio thereof, which is the SEM particle diameter divided by the flake thickness, is 100 to 500, and the organic vehicle is an ordinary one comprising a resin component such as ethyl cellulose dissolved in a solvent such as diethyleneglycol monobutylether acetate.

First, as shown in Table 1, conductive pastes according to this preferred embodiment and conductive pastes serving as comparison examples were made.

TABLE 1

| | Proportion of Flake-form Silver | Occurrence of Cracking | |
|---|---|---|---|
| Sample No. | Powder and Proportion of Organic Rhodium Solution | After Baking | After Plating |
| 1 | Flake-form Silver Powder 80 wt %<br>Organic Rhodium Soln. 0.5 wt % | No | No |
| 2 | Flake-form Silver Powder 40 wt %<br>Organic Rhodium Soln. 1.0 wt % | No | No |
| 3 | Flake-form Silver Powder 15 wt %<br>Organic Rhodium Soln. 3.0 wt % | No | No |
| 4 | Flake-form Silver Powder 15 wt %<br>Organic Rhodium Soln. 4.0 wt % | No | No |
| 5 | Flake-form Silver Powder 10 wt %<br>Organic Rhodium Soln. 3.0 wt % | No | Yes |

TABLE 1-continued

| Sample No. | Proportion of Flake-form Silver Powder and Proportion of Organic Rhodium Solution | Occurrence of Cracking After Baking | Occurrence of Cracking After Plating |
|---|---|---|---|
| 6 | Flake-form Silver Powder 85 wt % Organic Rhodium Soln. 3.0 wt % | No | No |
| 7 | Flake-form Silver Powder 85 wt % Organic Rhodium Soln. 0.0 wt % | No | Yes |
| 8 | Flake-form Silver Powder 10 wt % Organic Rhodium Soln. 0.0 wt % | Yes | Yes |
| 9 | Flake-form Silver Powder 0 wt % Organic Rhodium Soln. 0.0 wt % | Yes | Yes |
| 10 | Flake-form Silver Powder 0 wt % Organic Rhodium Soln. 3.0 wt % | Yes | Yes |

Samples 1 to 3 in Table 1 are conductive pastes according to this preferred embodiment: In Sample 1 the proportion of flake-form silver powder with respect to the total amount of silver powder is 80 wt %, and 0.5 wt % of organic rhodium solution, i.e. an amount of organic rhodium solution such that the proportion of rhodium contained with respect to the total amount of silver powder is 0.000014 wt %, is added. In Sample 2 the proportion of flake-form silver powder is 40 wt % and 1.0 wt % of organic rhodium solution such that the proportion of rhodium is 0.000028 wt % is added, and in Sample 3 the proportion of flake-form silver powder is 15 wt % and 3.0 wt % of organic rhodium solution such that the proportion of rhodium is 0.000086 wt % is added.

Samples 4 to 10 in Table 1 are all comparison examples of conductive pastes: In Sample 4 the proportion of flake-form silver powder with respect to the total amount of silver powder is 15 wt % and 4.0 wt % of organic rhodium solution such that the proportion of rhodium contained is 0.00011 wt % is added, and in Sample 5 the proportion of flake-form silver powder is 10 wt % and 3.0 wt % of organic rhodium solution such that the proportion of rhodium contained is 0.000086 wt % is added. In Sample 6 the proportion of flake-form silver powder is 85 wt % and 3.0 wt % of organic rhodium solution is again added, in Sample 7 the proportion of flake-form silver powder is 85 wt % and no organic rhodium solution whatsoever is added, and in Sample 8 the proportion of flake-form silver powder is 10 wt % and no organic rhodium solution whatsoever is added.

Sample 9 is a conventional conductive paste wherein all the silver powder is spherical and no organic rhodium is added whatsoever, and Sample 10 is one wherein all the silver powder is spherical and 3.0 wt % of organic rhodium solution such that the proportion of rhodium with respect to the total amount of silver powder is 0.000086 wt % is added.

Next, a 225 mesh polyester screen as a high mesh screen with a graphic pattern of heating strips formed therein and a low mesh screen, for example a 110 mesh polyester screen, with a graphic pattern for bus bars formed therein were prepared. Conductive paste Samples 1 to 10 were severally printed on the surface of a window glass 3 using the 225 mesh polyester screen and then dried to form multiple heating strips 1, and using the 110 mesh polyester screen the same conductive paste was printed and dried to form bus bars 2 connected to the heating strips 1.

Then, while strengthening of the window glass 3 was carried out at a temperature of 680° C., the heating strips 1 and the bus bars 2 were simultaneously baked on the surface of the window glass 3 to produce a defroster. Defrosters made by baking the conductive pastes 1 to 10 were examined for whether or not cracking had occurred at the boundaries of the heating strips 1 and the bus bars 2, and the examination results shown in the "After Baking" column of Table 1 were obtained. Also, each window glass 3 with a defroster baked thereon was sequentially immersed and electroplated in copper sulfate solution and then in nickel sulfate solution so that a plating film comprising a copper base layer and a nickel upper layer was thereby formed on the heating strips 1 and the bus bars 2; the samples were examined for the presence or absence of cracking and the examination results shown in the "After Plating" column of Table 1 were obtained.

According to these examination results, whereas absolutely no cracking occurred either after baking or after plating in the manufacture of defrosters using the conductive pastes of Samples 1 to 3, which were within the scope of the invention, and the comparison examples 4 and 6, with Sample 5 cracking was observed after plating and with Samples 7 to 10 cracking was found to have occurred both after baking and after plating.

The reason why the occurrence of cracking after plating is a problem here is that in cases such as when the surface area of the window glass 3 is large and the heating strips 1 are long and when the defroster also performs an antenna function, it is necessary to further reduce the resistance of the heating strips 1 and the bus bars 2 made of conductive paste and consequently it is usual to carry out copper plating thereof. The nickel plating is carried out to prevent oxidation of and improve the wear resistance of the copper plating film. That is, in practice it is a necessary condition in the manufacture of a defroster that cracking does not occur after plating.

It is also required of a conductive paste for manufacturing a defroster that the resistance after baking be less than 3.0Ω, because of the necessity of preventing heating of the bus bars 2, and that the tensile strength after baking be over 150 N (Newtons), because of the necessity of ensuring reliability during fitting of the window to a car. In this connection, first, using a 225 mesh polyester screen provided with a graphic pattern of length (L) 500 mm and width (W) 0.5 mm, i.e. having a length to width ratio (L/W) of 1000, the conductive pastes shown in Table 1 were printed and dried and then baked at a temperature of 680° C., the resistances between the ends of the lines formed by baking were measured, and the measurement results are shown in Table 2. The resistances figures in Table 2 have been converted to correspond to a line film thickness of 10 μm.

TABLE 2

| Sample No. | Proportion of Flake-form Silver Powder and Proportion of Organic Rhodium Solution | Resistance (Ω) (L/W-1000) | Tensile strength (N) |
|---|---|---|---|
| 1 | Flake-form Silver Powder 80 wt % Organic Rhodium Soln. 0.5 wt % | 2.7 | 190 |
| 2 | Flake-form Silver Powder 40 wt % Organic Rhodium Soln. 1.0 wt % | 2.5 | 210 |
| 3 | Flake-form Silver Powder 15 wt % Organic Rhodium Soln. 3.0 wt % | 2.9 | 180 |
| 4 | Flake-form Silver Powder 15 wt % Organic Rhodium Soln. 4.0 wt % | 3.5 | 130 |
| 5 | Flake-form Silver Powder 10 wt % Organic Rhodium Soln. 3.0 wt % | 2.8 | 220 |
| 6 | Flake-form Silver Powder 85 wt % Organic Rhodium Soln. 3.0 wt % | 4.2 | 100 |
| 7 | Flake-form Silver Powder 85 wt % Organic Rhodium Soln. 0.0 wt % | 3.3 | 160 |

TABLE 2-continued

| Sample No. | Proportion of Flake-form Silver Powder and Proportion of Organic Rhodium Solution | Resistance (Ω) (L/W-1000) | Tensile strength (N) |
|---|---|---|---|
| 8 | Flake-form Silver Powder 10 wt % Organic Rhodium Soln. 0.0 wt % | 2.4 | 220 |
| 9 | Flake-form Silver Powder 0 wt % Organic Rhodium Soln. 0.0 wt % | 2.2 | 200 |
| 10 | Flake-form Silver Powder 0 wt % Organic Rhodium Soln. 3.0 wt % | 2.6 | 180 |

Also, a metal terminal L-shaped as seen from the side having a solder portion 5 mm square as seen in plan view was soldered to the baked bus bar 2 and by pulling this metal terminal in a direction orthogonal to the surface of the window glass 3, the tensile strength of the bus bar 2 was measured. The measurement results shown in Table 2 were obtained. From these measured results it can be seen that whereas Samples 1 to 3 which were conductive pastes within the scope of the invention all had resistances of less than 3.0Ω and tensile strengths of over 150 N and fulfilled the requirements, both the resistances and the tensile strengths of the conductive pastes of the comparison examples 4 and 6 did not satisfy the requirements.

That is, although Samples 4 and 6 satisfied the previously investigated requirement that no cracking occur, they did not fulfill the resistance and tensile strength requirements. Furthermore, although the conductive pastes of Samples 5, 8, 9 and 10 each met the resistance and tensile strength requirements, because cracking occurred in these samples they did not satisfy all the requirements, and the conductive paste of Sample 7 did not meet the requirements of resistance and tensile strength or of cracking. In this preferred embodiment, the bus bars 2 were formed after first forming the heating strips 1, but the same results can be obtained by forming the heating strips 1 after forming the bus bars 2. Also, although in this preferred embodiment the conductive pastes are for manufacturing defrosters, their application is of course not limited to this.

As described above, when a conductive paste according to this invention is used, the occurrence of cracking at boundaries between areas of different film thicknesses both after baking and after plating can be effectively prevented while resistance and tensile strength are maintained within a practically sufficient range.

What is claimed is:

1. A conductive paste comprising spherical silver powder, flake-form silver powder, low softening point glass frit, organic rhodium material and an organic vehicle, wherein:

the proportion of the flake-form silver powder with respect to the total amount of silver powder is in the range of about 15 to 80 wt %; and the proportion of the rhodium contained in the organic rhodium material with respect to the total amount of silver powder is 0.00001 to below about 0.001 wt %.

2. The conductive paste of claim 1 wherein the microtrack $D_{50}$ of the spherical silver powder used is about 1 to 2 μm.

3. The conductive paste of claim 1 wherein the SEM particle diameter (average of long and short dimensions of the flake) of the flake-form silver powder is 3 to 30 μm.

4. The conductive paste of claim 1 wherein the ratio of the SEM particle diameter divided by the thickness of the flake-form silver powder is 100 to 500.

5. The conductive paste of claim 1 wherein the viscosity of the paste is 80 to 100 Pascal seconds.

6. The conductive paste of claim 5 wherein the proportion of the rhodium with respect to the total amount of silver powder is about 0.00001 to 0.001 wt %.

7. The conductive paste of claim 6 wherein the microtrack $D_{50}$ of the spherical silver powder used is about 1 to 2 μm.

8. The conductive paste of claim 7 wherein the SEM particle diameter (average of long and short dimensions of the flake) of the flake-form silver powder is 3 to 30 μm.

9. The conductive paste of claim 8 wherein the ratio of the SEM particle diameter divided by the thickness of the flake-form silver powder is 100 to 500.

10. A glass substrate having a layer of the paste of claim 1 on a surface thereof.

11. A glass substrate having a layer of the paste of claim 5 on a surface thereof.

12. A glass substrate having a layer of the paste of claim 9 on a surface thereof.

13. A glass substrate having the paste of claim 1 on a surface thereof in a predetermined pattern.

14. The glass substrate of claim 13 in which the pattern comprises a plurality of generally parallel strips.

15. The glass substrate of claim 14 in which the plurality of strips are interconnected by at least one additional strip of said paste.

* * * * *